US005589736A

United States Patent [19]

Lien et al.

[11] Patent Number: 5,589,736

[45] Date of Patent: Dec. 31, 1996

[54] FREQUENCY MULTIPLIER INCLUDING GRID HAVING PLURAL SEGMENTS

[75] Inventors: Erling L. Lien, Los Altos; Arthur Karp, Palo Alto, both of Calif.

[73] Assignee: Communications and Power Industries, Inc., Palo Alto, Calif.

[21] Appl. No.: 237,731

[22] Filed: May 4, 1994

Related U.S. Application Data

[62] Division of Ser. No. 508,442, Apr. 13, 1990, Pat. No. 5,317,233.

[51] Int. Cl.[6] ..... H01J 25/02

[52] U.S. Cl. ..... 315/5.43; 315/5.37; 313/293; 313/447

[58] Field of Search ..... 315/5.37, 5.39, 315/5.43, 5.44; 313/293, 447

[56] References Cited

U.S. PATENT DOCUMENTS

| | | | |
|---|---|---|---|
| 2,514,383 | 7/1950 | Feenberg | 315/5.43 |
| 2,544,675 | 3/1951 | Hamilton | 315/5.43 |
| 2,617,959 | 11/1952 | Fay | 313/293 |
| 3,392,300 | 7/1968 | Arnaud et al. | 315/5.37 X |
| 4,227,116 | 10/1980 | Miram et al. | 313/447 |
| 5,317,233 | 5/1994 | Lien et al. | 315/5.37 |

*Primary Examiner*—Benny T. Lee
*Attorney, Agent, or Firm*—Lowe, Price, Leblanc & Becker

[57] ABSTRACT

The frequency of an AC signal is multiplied by a factor N, where N is an integer greater than one, by an electron tube including a cathode for emitting an electron beam and a grid including N segments in proximity to the cathode. The grid is biased and coupled to the signal so the beam is formed as N groups of electron bunches during each cycle of the signal. Each segment accelerates one group of bunches for a duration of about 1/N th of each cycle of the signal. Different groups of bunches associated with the different segments are accelerated at phases displaced from each other during each cycle of the signal. In response to the N groups of bunches an output signal having a frequency N times that of the signal is derived.

14 Claims, 8 Drawing Sheets

146.11
146.10
146.9
146.8
146.7
146.6
144.4
144.5
144.6
143.6
143.5
143.3
143.4
132
143.2
143.1
133
151
146.11'
146.10'
131
146.9'
146.5
146.8'
146.7'
146.4
151'
146.6'
146.9'
145.6
145.5
145.4
145.3
146.3
138
145.2
146.2
145.1
146.1
139
137
134
203
135
136
140
45°
22.5°

FREQUENCY MULTIPLIER INCLUDING GRID HAVING PLURAL SEGMENTS

This application is a division of application Ser. No. 07/508,442, filed Apr. 13, 1990, now U.S. Pat. No. 5,317,233 issued May 31, 1994.

FIELD OF THE INVENTION

The present invention relates generally to frequency multipliers employing high-frequency vacuum tubes and, more particularly, to a frequency multiplying high-frequency vacuum tube having a grid including N segments proximate an electron emitting cathode, wherein the grid causes the beam to be formed as N electron bunches during each cycle of an input signal to be frequency multiplied, and N is an integer greater than 1. The term "r.f." as utilized in the specification and claims of the present document refers to frequencies in the VHF, UHF and microwave regions.

BACKGROUND ART

A recently developed vacuum tube for handling r.f. signals includes a cathode for emitting a linear electron beam, a grid positioned at right angles to the direction of flow of the beam in close proximity to the cathode (no farther than the distance an emitted electron can travel in a quarter of an r.f. cycle at the highest frequency being handled by the tube) for current modulating the beam, and a cavity resonant to the frequency of the signal positioned between the grid and a collector electrode for the beam. The grid is coupled by a structure resonant to the frequency being handled by the tube to an r.f. input signal to be amplified by the tube. To prevent electron emission from the grid, it is formed of a non-emissive material, such as pyrolytic graphite or molybdenum coated with zirconium.

As applied to the electron beam flowing beyond the grid, the terms "current-modulated," "space-charge-modulated," "density-modulated" and "intensity-modulated" are synonymous, and refer to concentrations (or "bunches") alternating with depletions of particle density (or space-charge density) along the beam. Speeding and slowing of particle velocity is indicated by the term "velocity modulation."

Very high efficiency is achieved with such a tube by biasing the grid so that current flowing from the cathode toward the grid occurs for no more than one half cycle of the r.f. signal handled by the tube. Typically, the bias voltage between the grid and cathode is very small or zero.

In one prior art configuration, the resonant input circuit supplies electric fields having opposing phases between the cathode and grid and between the grid and an accelerating anode positioned between the grid and the output cavity. In another prior art modification, a second resonant cavity positioned between the output cavity and the accelerating anode is adjusted so the resonance frequency thereof is above the frequency being handled by the tube, to increase the average efficiency of the tube. These prior art structures are disclosed in the commonly assigned U.S. Pat. Nos. 4,480,210, 4,527,091 and 4,611,149. Devices incorporating the teachings of at least some of these patents are commercially available from the assignee of the present invention under the registered trademark KLYSTRODE.

The resonant coaxial cavity couples an input signal to an assembly including the cathode and grid. This resonant cavity has a length in the direction of the beam axis that is nominally either a half-wavelength at the frequency handled by the tube or a full wavelength at this frequency. In practice, it is most usually the latter.

The r.f. input signal to be amplified is transformer-coupled to the input resonant cavity which couples the field established in the cavity to the grid-cathode and grid-anode regions, in response to the input signal. In this document, the phrase "transformer coupled to the cavity" signifies that the r.f. power coming into or going out of a coaxial cable is coupled by r.f. magnetic fields to the cavity via loop coupling or by r.f. electric fields via probe coupling.

SUMMARY OF THE INVENTION

In one embodiment of the present invention, a slow wave structure includes a spiral preferably having first and second ends respectively in central and peripheral regions of the conductive structure. Plural such spirals are preferably provided in an interlaced arrangement such that the second ends of the spirals are arranged around the periphery of a circle. Adjacent second ends of all of the spirals are spatially displaced by $$\frac{2\pi}{N}$$

radians, where N is the number of spirals. The N spirals can be excited by an r.f. signal with the same phase. Preferably, however, the N spirals are driven with phase displaced r.f. signals so that the r.f. signal coupled to adjacent spirals is phase displaced by $$\frac{2\pi}{N}$$

radians. With proper DC bias between the grid cathode, such an arrangement enables the frequency of the r.f. signal to be multiplied by N.

Hence, in accordance with a further aspect of the invention, the frequency of an AC signal is multiplied by a factor N, where N is an integer greater than 1, with an electron tube including a cathode for emitting an electron beam, in combination with a grid including N segments in proximity with the cathode. The grid is biased and coupled to the signal for causing the beam to be formed as N groups of electron bunches during each cycle of the signal, so that each of the segments accelerates one group of bunches for a duration of about 1/Nth of a cycle of the AC signal. Different groups of bunches associated with the different segments are accelerated at phases displaced from each other during each cycle of the signal. An output structure responds to the N groups of bunches to derive an output signal having a frequency N times that of the signal.

In the preferred embodiment, the N groups of electron bunches are derived by phase shifting the signal applied to each of the segments so that the signal supplied to segment k is phase shifted by $$\frac{2\pi(k-1)}{N}$$

relative to the signal applied to segment 1. The grid is preferably configured as a pancake having a planar surface at substantially right angles to the direction of electron beam flow. Each of the segments intersects a portion of the beam through an angular extent of at least 360° at different radial positions of the beam. The latter configuration is attained by the interlaced spiral grid structure.

It is, accordingly, an object of the invention to provide a new and improved electron tube frequency multiplier.

Another object of the invention is to provide a new and improved electron tube frequency multiplier which simultaneously provides substantial amplification of an r.f. signal modulating an electron beam.

Still another object of the invention is to provide an electron tube amplifier for an r.f. signal with a grid that forms a resonant coupling circuit between an electron beam and an r.f. signal, while providing frequency multiplication of the r.f. signal, as reflected in multiple groups of electron bunches during each cycle of the r.f. signal.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENTS

Figure 1:
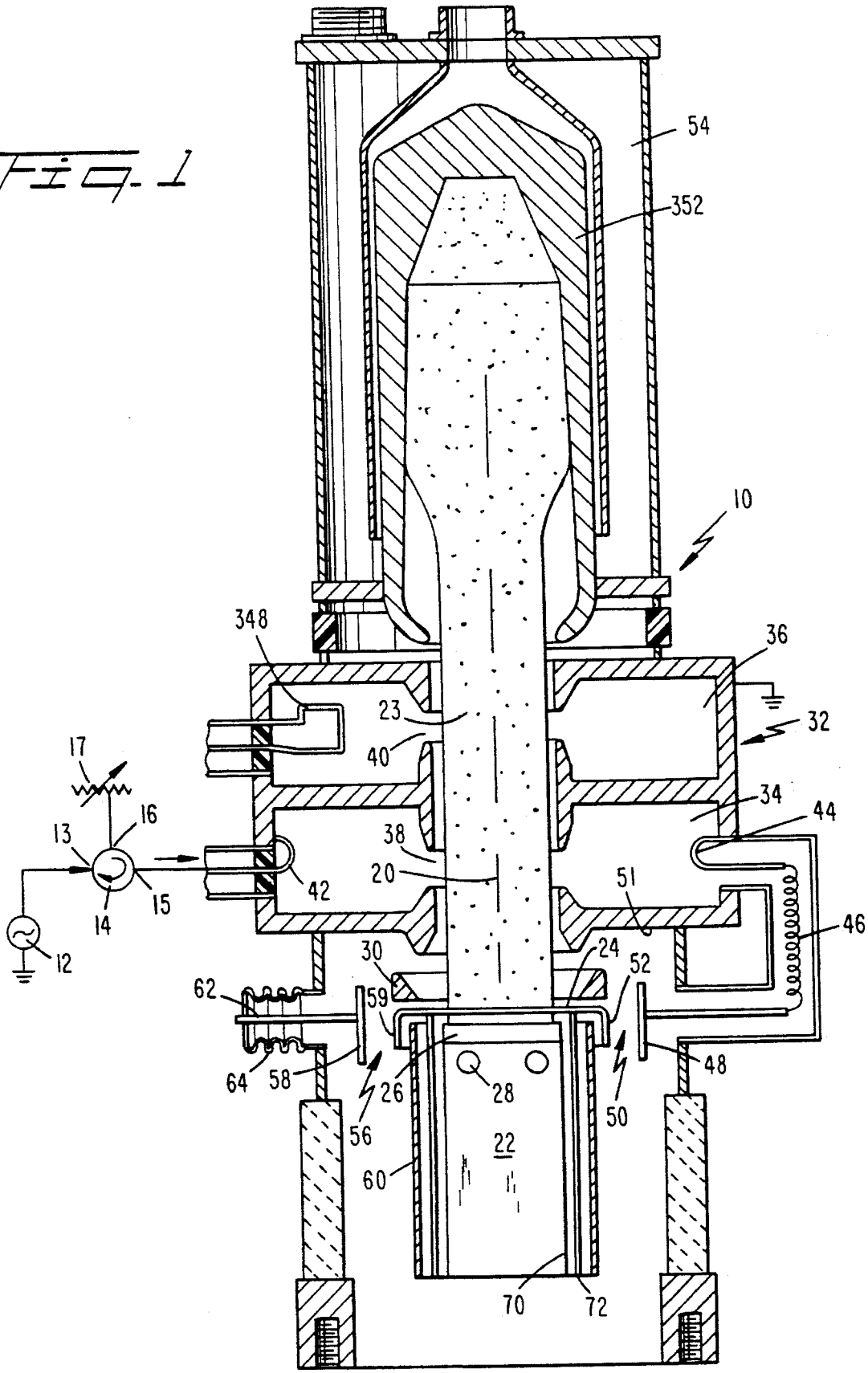
FIG. 1 is a longitudinal-sectional view of a vacuum tube wherein an electron beam is responsive to an r.f. signal so that the signal causes the beam to be current-modulated by a control grid and to be velocity modulated by a tuned cavity prior to being coupled to an output cavity.

Reference is now made to FIG. 1 of the drawings wherein there is illustrated a linear electron-beam tube 10 including features of the present invention. Tube 10 is responsive to r.f. source 12, which may have a frequency in a relatively narrow range centered anywhere in the VHF range through the microwave range. Signal source 12 is coupled to an input of tube 10 by way of port 13 of circulator 14, having further ports 15 and 16 respectively connected to the input of the tube and to terminating impedance load 17 which absorbs energy reflected by the input of tube 10 back to port 15. The impedance value of load 17 is adjusted so that it matches the load connected to circulator 14 and thereby prevents reflections.

Tube 10 is configured as an elongated structure having a vacuum envelope including metal and dielectric parts around longitudinal axis 20. Tube 10, generally of circular cross-sectional configuration, is arranged so that many of the cross-sections are surfaces of revolution about axis 20.

At one end of tube 10 is grid-cathode-focus electrode assembly 22 which is coupled to the r.f. signal that first enters at port 15 so as to derive a linear electron beam that is coaxial with axis 20 and density modulated in response to r.f. variations of signal 12. Electron beam 23, having a circular cross-section, is derived as electron bunches in response to a current-modulation process imposed by control grid 24 on the electron beam derived from cathode 26, externally heated by heater coil 28.

Grid 24 and cathode 26 are typically at the same DC potential, while an r.f. field is developed in the space between the grid and cathode in the propagation direction of beam 23. The r.f. field between grid 24 and cathode 26 is developed in response to the signal of source 12. The r.f. field between grid 24 and cathode 26 and the DC bias of the grid and cathode are such that electron beam 23 flows only during approximately one half of each cycle of r.f. source 12 as described in U.S. Pat. No. 4,611,149. Grid 24 is essentially planar, while the emitting surface of cathode 26 is also essentially planar with the planar surfaces of the grid and cathode being parallel to each other and spaced from each other by less than the distance an emitted electron can travel in a quarter of an r.f. cycle at the highest frequency to be amplified by tube 10. This spacing between grid 24 and cathode 26 is necessary to enable the grid to current modulate the electron beam derived by cathode 26 properly. Grid 24 and cathode 26 can also be surfaces with spherical curvature, wherein the indicated spacing between them is maintained.

Assembly 22 also includes annular focus electrode 30, positioned immediately downstream of grid 24. Focus electrode 30 is maintained at the same AC and DC potential as cathode 26. One function of focus electrode 30 is to prevent divergence of electron beam 23 so that the beam passes through hollow ring-like structures downstream from the focus electrode, without interception of electrons by these hollow parts. Focusing can, if necessary, be aided by a magnetic coil structure wound about the envelope of tube 10 so that the coil is coaxial with axis 20. Another function of the focus electrode is to protect the grid and its bias power supply from damage by a high-voltage arc that might accidentally strike between the anode and the grid-cathode-focus assembly; with the focus electrode at the same r.f. and DC potentials as the cathode, an arc would strike only between the anode and the relatively robust focus electrode. Grid-cathode-focus electrode assembly 22 is described in detail for one embodiment in connection with FIGS. 2–4, and modified grid-cathode-focus-assembly embodiments are described in connection with FIGS. 6–10. Cathode 26 is a flat disc-shaped structure, preferably of the impregnated tungsten-matrix type, while grid 24 is preferably a temperature-resistant carbon, usually pyrolytic graphite, although it could also be formed of other non-electron-emissive materials, such as molybdenum coated with zirconium.

Current-modulated electron beam 23 propagates from assembly 22 through metal resonant-cavity assembly 32, maintained at DC ground potential. Cavity assembly 32 includes two resonant cavities 34 and 36 located in the named order from assembly 22 along axis 20. Cavities 34 and 36 are coupled to beam 23 by gaps 38 and 40, respectively. The resonance frequency of cavity 34 is slightly above the center frequency of source 12 so that the cavity can be considered as inductively tuned. Cavity 36 is similarly dimensioned.

Cavity 34 includes transformer loop 42, connected to port 15 of circulator 14 so that cavity 34 has a direct AC connection to source 12. Cavity 34 includes a second loop 44, connected via adjustable delay line 46 to plate 48 of capacitor 50, which also includes tab or plate 52 that is an integral extension of grid 24. Plates 48 and 52 extend generally parallel to each other, in closely spaced relationship, to couple the r.f. signal of source 12 to grid 24 after the r.f. signal has been coupled through circulator 14, cavity 34 and delay line 46. While delay line 46 is illustrated schematically as a helix within vacuum tube 10, for many purposes the delay line may be located outside of the vacuum to facilitate adjustment thereof. In a preferred embodiment, delay line 46 is configured as a cable with a changeable length as can be attained with a slide trombone-like structure.

Cavity 36 includes loop 348 on which is derived a signal that is a replica of the field variations in the cavity in response to the modulation imposed on beam 23 by grid 24 and cavity 34. The signal induced in loop 348 is supplied to a suitable load, such as a transmitting antenna.

Cavity 34 produces velocity modulation bunching of electron beam 23, phased relative to the density modulation imposed on the beam by grid 24, so as to enhance the net current modulation in the beam as it reaches output gap 40 of output cavity 36. To this end, delay line 46 is adjusted so that the r.f. output signal derived by loop 348 is maximized. Because of the direct connection for the AC excitation of cavity 34 by the r.f. signal of source 12 via loop 42 and the controllable phase delay introduced by delay line 46 between cavity 34 and grid 24, the signal derived by loop 348 can be precisely maximized.

Assembly 32, being at DC ground potential, functions as an accelerating electrode for electron beam 23. Face 51 of assembly 32, extending generally parallel to grid 24 and closer to the grid than any other part of assembly 32, accelerates electron beam 23 toward assembly 32. Electron beam 23 passes through assembly 32 into collector 352. Collector 352 is cooled by a conventional cooling means, including water jacket 54 that envelopes the collector. Resonant cavity assembly 32 is cooled by an external medium in a conventional manner, not shown.

The electric field between grid 24 and cathode 26 is developed in response to the field capacitively coupled from plate 48 to tab 52 that extends from and is a part of the grid and forms a plate of capacitor 50. The electric field between grid 24 and cathode 26 is maximized by providing one of these electrodes with a resonant slow-wave circuit preferably formed as plural meander lines each having an electric length that is approximately one-quarter or three-quarters of the wavelength of the center frequency of source 12. Fine tuning for the signal coupled by delay line 46 to grid 24 is provided by capacitor 56 including plate 58 and tab 59, downwardly depending from grid 24. Tabs 52 and 59 extend from opposite sides of grid 24 through diametrically opposed slots in metal cylindrical support sleeve 60 for focus electrode 30. Sleeve 60 is coaxial with axis 20 and includes upwardly extending arms (not shown) for carrying focus electrode 30. Plate 58 is attached to stem 62, secured to metal bellows 64 in the envelope of tube 10. The value of capacitor 56 is varied by adjusting bellows 64 to alter the distance between tab 59 and plate 58.

Figure 2:
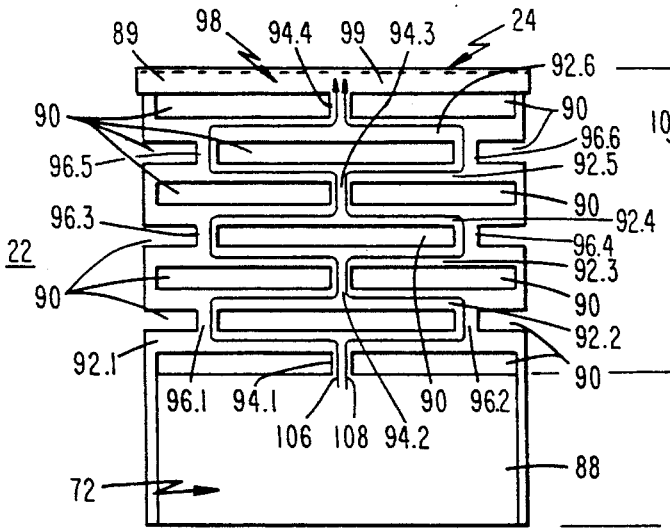
FIG. 2 is a side view of a support structure for one embodiment of a control grid of the tube of FIG. 1, wherein the support structure includes plural, parallel resonant meander lines.
Figure 4:
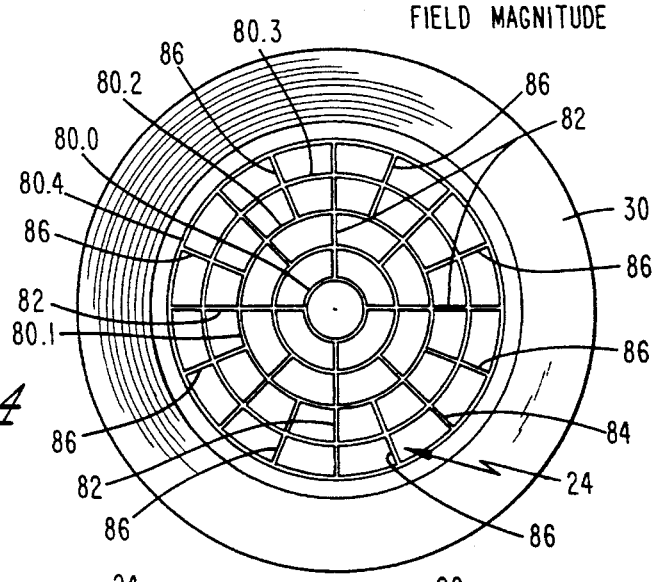
FIG. 4 is a top view of the structure illustrated in FIG. 3.
Figure 3:
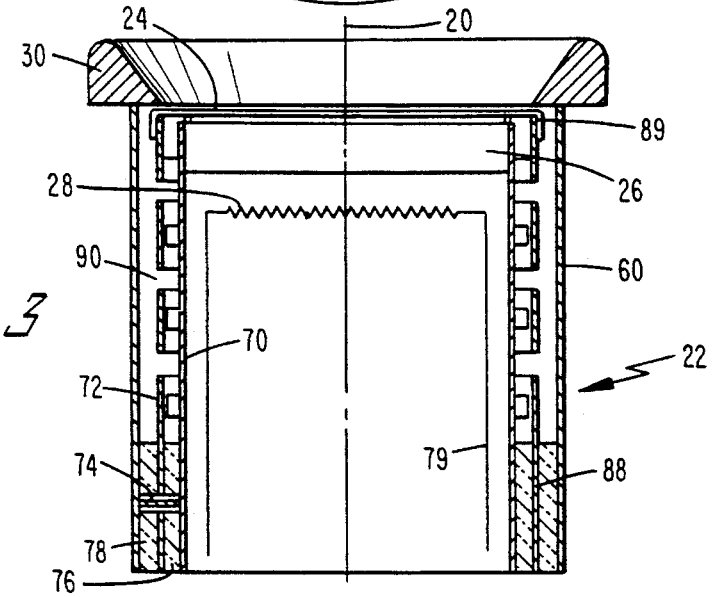
FIG. 3 is a longitudinal-sectional view of a cathode-control grid-focus electrode assembly for the tube of FIG. 1, in accordance with one embodiment of the invention, wherein a support structure for the control grid is configured as illustrated in FIG. 2.

Reference is now made to FIGS. 2–4 wherein details of the grid-cathode-accelerator electrode assembly 22 of FIG. 1 are illustrated. From assembly 22 is derived a density-modulated linear electron beam having a solid, circular cross-section. Assembly 22 is resonantly coupled to input signal source 12 to derive electron beam bunches having a duty cycle of approximately 50%; each bunch is a replica of alternate half cycles of the r.f. waveform of source 12 subject to the instantaneous current being proportional to the 3/2 power of the voltage, with zero DC grid bias voltage. The electron beam bunches are derived during the interval while grid 24 is positive relative to cathode 26.

As illustrated in FIG. 3, assembly 22 includes metal cylinders 70, 72 and 60, which respectively support cathode 26, grid 24 and focus ring 30. Assembly 22 also includes heating coil 28 for cathode 26, schematically illustrated in FIG. 3 as a resistor located beneath cathode 26 and supported by strut 79. Cylinders 70, 72 and 60, all coaxial with longitudinal axis 20, have progressively increasing radii. Cylinders 60 and 70 are electrically connected to each other by metal straps 74 that extend radially through gaps in cylinder 72 so that cathode electrode 26 and focus electrode 30 are at the same DC potentials. Grid support cylinder 72 is insulated for r.f. and DC purposes and spaced from cathode 26 and focus electrode 30 by ceramic insulating rings 76 and 78, which provide mechanical support between cylinders 70, 72 and 60. Rings 76 and 78 have a high dielectric constant, being preferably fabricated of alumina. Rings 76 and 78 include slots through which straps 74 extend. Grid 24 and cathode 26 are electrically excited one relative to the other by the AC signal of source 12 and are connected to a bias network so that the grid and cathode may be at different DC potentials. This DC potential difference is preferably close to zero; thereby, during alternate half cycles of the signal of source 12, electron beam 23 is cut off; during the other half cycles of source 12, current flows in the beam in response to a substantial forward accelerating field developed between cathode 26 and grid 24.

Grid 24 which current modulates the electron beam 23 derived from cathode 26 is electron permeable as a result of the grid being constructed of spaced circumferentially extending metal elements 80.0–80.4 (FIG. 4), as well as spaced radially extending elements 82, 84, and 86; elements 80.0–80.4, 82, 84 and 86 resemble individual wires. Since the cross-sectional area of circular beam 23 is slightly less than the circular area of grid 24 and the beam and grid are coaxial, the entire beam passes through the grid. As illustrated in FIG. 4, all of circumferential elements 80.0–80.4 are circular, being coaxial with longitudinal axis 20, such that different ones of elements 80.0–80.4 are at different radial positions from axis 20. Together, radially extending elements 82, 84 and 86 connect circular elements 80.0–80.4. Elements 82 are spaced 90° from each other and extend between the inner and outermost circumferential elements 80.0 and 80.4. Elements 84 are also spaced from each other by 90° but are spaced from elements 82 by 45°; elements 84 are connected between circumferential element 80.1 having the next smallest radius and circumferential element 80.4 having the largest radius. Elements 86 are spaced from each other by 45°, being equally spaced from elements 82 and 84; elements 86 extend between the circumferential element 80.2 having a median radius and the circumferential element 80.4 having the largest radius.

The illustrated arrangement of the circumferential and radially extending elements causes the area of each sector, defined by a pair of adjacent radially extending elements and circumferentially extending elements, to be about the same. (In actuality, the number of radial and circumferential elements in grid 24 is considerably in excess of that illustrated in FIG. 4 to make the drawing more easily understood. However, the general principle of maintaining the area of each sector between adjacent radial and circumferential elements is applicable.) Because beam 23 has a diameter that is small compared to a quarter wavelength of the highest frequency to be handled by tube 10 and the areas of the sectors of grid 24 are about the same, grid 24 current modulates beam 23 approximately uniformly over the entire cross-sectional area of the beam. To prevent electron emission from grid 24 itself, the grid is fabricated of a nonemissive material, such as pyrolytic graphite or molybdenum coated with zirconium. To assist in establishing a somewhat uniform electric field in the dielectric gap between grid 24 and cathode 26, the electron emitting planar face of the cathode, which is parallel to the plane of the grid, is spaced by no more than the distance an emitted electron can travel in a quarter of an r.f. cycle at the highest frequency of source 12.

To resonantly couple the signal of source 12 to grid 24, an electrode assembly including grid electrode 24 and cathode electrode 26 includes a slow-wave resonant circuit. In the embodiment of FIGS. 2–5, the slow-wave resonant circuit comprises eight parallel meander lines formed in grid support sleeve 72.

In the specific configuration illustrated in FIGS. 2–4, and particularly as partially illustrated in FIG. 2, the slow-wave structure includes eight parallel meander lines in grid support sleeve 72. Each meander line subtends an angle of 45° about the circumference of sleeve 72. Each meander line extends between lower portion 88 of sleeve 72 where a connection is established for the grid DC bias voltage and the uppermost portion 89 of the sleeve which is electrically and mechanically connected to outer circumferential element 80.4 of grid 24.

The meander lines are formed by etching circumferential slots 90 (FIG. 2) in sleeve 72 so each meander line is basically a delay line having series inductance and shunt capacitance. The series inductance includes the conducting metal portions of sleeve 72 between slots 90, while the shunt capacitance is established across the slots. Each meander line thus includes circumferentially extending metal portions 92.1–92.6, equal-length longitudinally-extending metal portions 94.1–94.4 and 96.1–96.6 that are axially and circumferentially offset from each other, and slots 90. To facilitate the discussion, the metal portions are generally referred to as portions 92, 94 and 96, but specific portions are illustrated on FIG. 2 as portions 92.1–92.6, 94.1–94.4, 96.1–96.6 etc.). Adjacent pairs of elements 94.1–94.4 and 96.1–96.6 are offset from each other by 45° around the perimeter of sleeve 72 and are axially spaced by the distance separating adjacent pairs of elements 92. Adjacent pairs of meander lines share longitudinally extending elements 94.1–94.4 and 96.1–96.6.

Two meander lines 98 and 99 of the eight included in grid support sleeve 72 illustrated in FIG. 2 are identified by current paths drawn on them. To provide a resonant structure between the lower and upper portions 88 and 89 of sleeve 72, each of the meander lines on the sleeve has a length that is electrically either about a quarter wavelength or three quarters of a wavelength of the frequency of source 12. While the electrical lengths of the meander lines may theoretically be any odd multiple of a quarter wavelength, for a practical tube having a minimum length, the electrical length of the meander lines should not exceed three quarters of a wavelength of the lowest frequency in the band of source 12.

Figure 5:
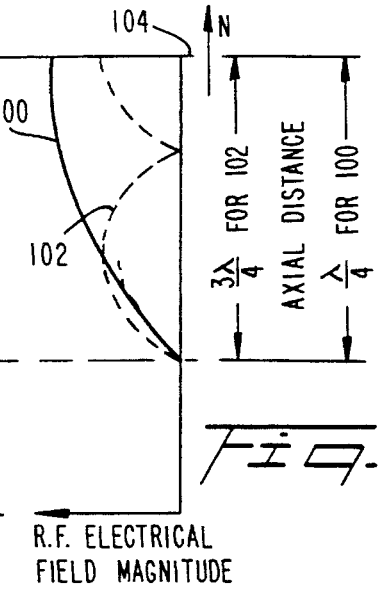
FIG. 5 is a diagram of the electric field variation, as a function of spatial position, along the length of the grid support structure of FIG. 2, for two different r.f. excitation frequencies.

Because the meander lines have electric lengths that are either a quarter wavelength or three quarters of a wavelength of the operating frequency of source 12, the distribution of peak electric field magnitude as a function of distance between the lower and upper portions 88 and 89 of sleeve 72 relative to cathode support sleeve 70 is represented as a sinusoid having either a 90° variation or a 270° variation, as illustrated in FIG. 5 by magnitude-only waveforms 100 and 102, respectively. At the lower portion of sleeves 70 and 72, where the sleeves are electrically connected to the low-voltage DC bias source, there is a zero r.f. radial electric field between the sleeves. At upper end 89 of sleeve 72, the r.f. electric field between sleeves 70 and 72 has a maximum value, as indicated by the intercept of waveforms 100 and 102 with line 104, FIG. 5. Hence, the electric field, E, has a variation indicated by the previously presented equation; for the situation of waveforms 100 and 102, n=0 and n=1.

Waveforms 100 and 102 represent the magnitude of the electric field between sleeves 70 and 72 as a function of axial position between regions 88 and 89. The electric field, E, between sleeves 70 and 72 is approximately:

$$E = \sin\left[\frac{(2n+1)\pi}{2}\right]\frac{x}{L}$$

where L=the total length of the resonant slow-wave structure;

x=variable distance along the length of the resonant slow-wave structure and n=zero or a positive integer (for practical purposes, n=0 or 1). The electric field in the gap between upper region 89 of sleeve 72 and sleeve 70 for supporting cathode 26 is relatively constant throughout the parallel planes subsisting between the electron emitting surface of the cathode and the plane of the grid containing elements 80.0–80.4, 82, 84 and 86 because the diameter of the grid is less than a quarter length of the highest frequency of source 12. Thereby, electron beam 23 is intensity modulated approximately to the same extent throughout each particular cross section thereof, although different cross sections are modulated by differing amounts.

The parallel current paths through the inductive impedances of meander lines 98 and 99 between regions 88 and 89 are respectively illustrated in FIG. 2 by current path lines 106 and 108. Initially, both of current paths 106 and 108 extend longitudinally, i.e., axially, from region 88 through the longitudinal segment 94.1 adjoining region 88. After traversing segment 94.1, current paths 106 and 108 divide at circumferential segment 92.1 so current paths 106 and 108 extend in opposite directions. Current paths 106 and 108 extend through segment 92.1 until they reach axial segments 96.1 and 96.2, respectively. Current paths 106 and 108 extend through longitudinal regions 96.1 and 96.2 until they encounter the next circumferential region 92.2. Then, current paths 106 and 108 extend toward each other along region 92.2, until they reach longitudinal region 94.2, aligned with region 94.1. Current paths 106 and 108 continue in this manner, with the current paths being directed in opposite directions through alternate circumferential conducting regions 92.

Current paths 106 and 108 share longitudinally extending conducting regions 94.1–94.4 with similar current paths in the two meander lines abutting against meander lines 98 and 99. At any particular time, the current flow directions in all of the meander lines are the same. Because the meander lines are an odd multiple of a quarter wavelength in total length, they are resonant circuits. The meander lines on grid support sleeve 72 are somewhat increased in resistance, i.e., decreased in Q, because of warming due to the heat radiated to them from cathode support sleeve 70.

Figure 7:
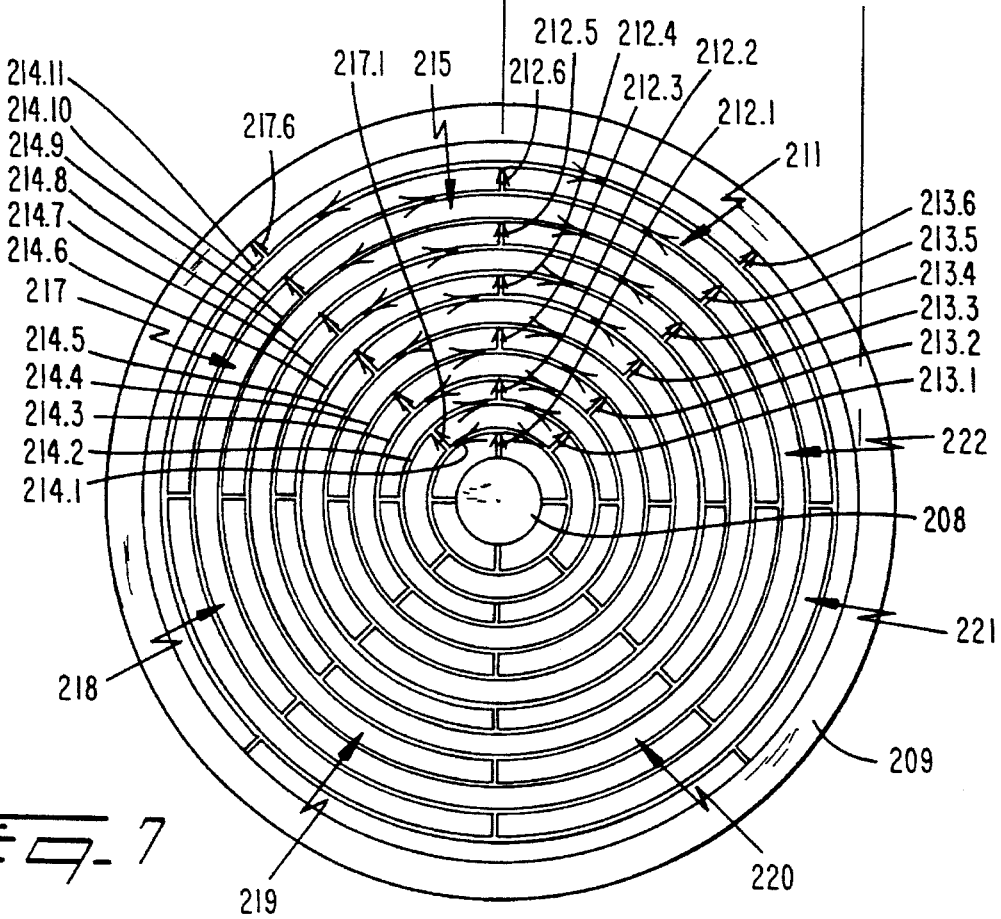
FIG. 7 is a top view of the structure illustrated in FIG. 6.
Figure 6:
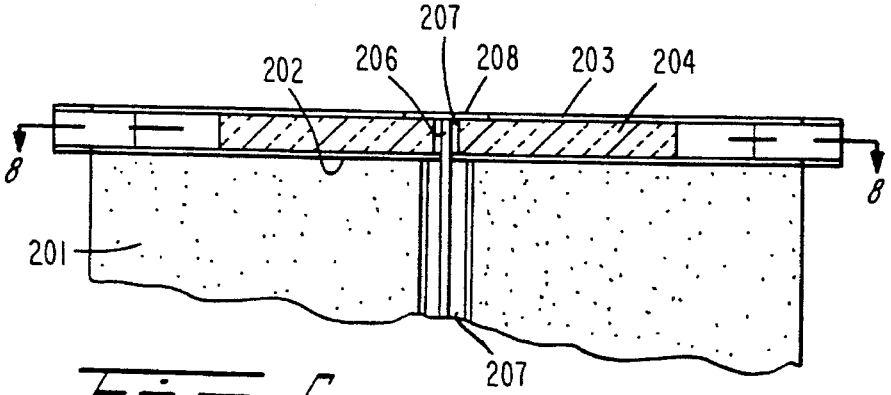
FIG. 6 is a longitudinal-sectional view of a cathode-control grid-focus electrode structure for a tube similar to that of FIG. 1, in accordance with a second embodiment of the invention.
Figure 8:
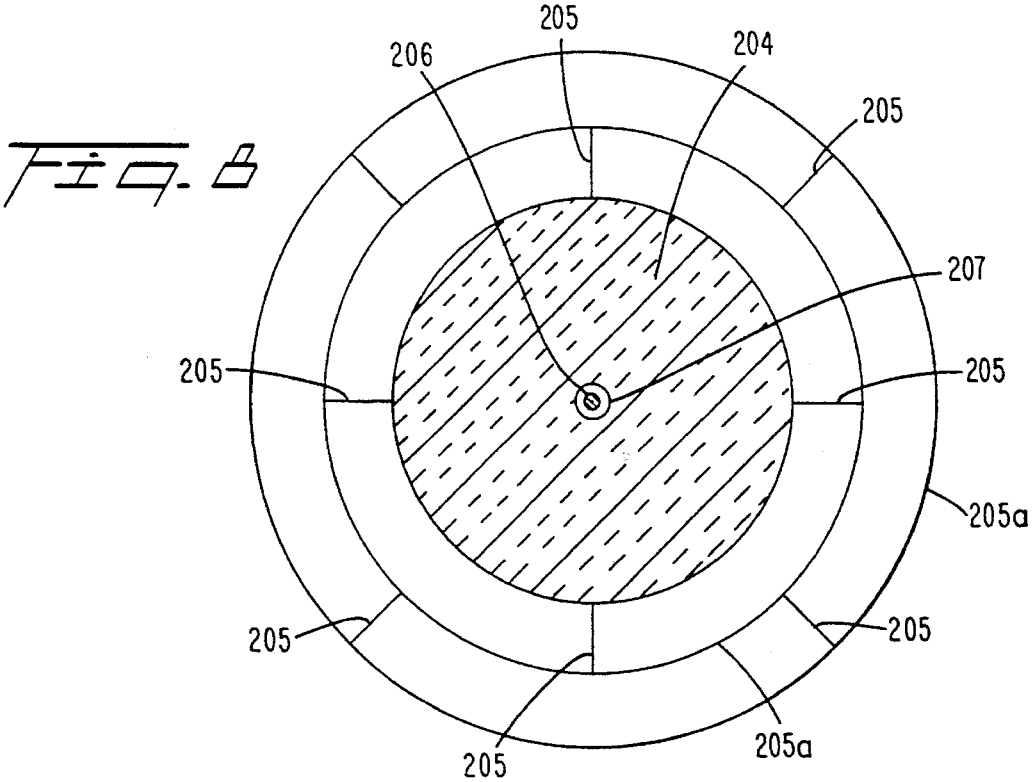
FIG. 8 is a cross-sectional view, taken through the lines 8—8, FIG. 6.

An alternate embodiment of the cathode-control grid-focusing electrode structure is illustrated in FIGS. 6–8 as including cathode cylinder 201, focus electrode 202 and control grid 203. At the top of cylinder 201 is a generally planar upper electron-emitting surface, the central part of which is covered by electrode 202, configured as a circular non-electron-emissive metal plate, at the same DC voltage as cathode 201. Substantially planar control grid 203, which is configured as an ensemble of slow-wave meander lines, and extends parallel to the emitting face of cathode 201, is coupled to source 12 via a metal tab (not shown) which is basically the same as tab 52; the tab of grid 203 is coupled to source 12 by the same structure that connects grid 24 to source 12.

As illustrated in FIG. 8, electrode 202 has the same conductor pattern, including radial and circular elements 205 and 205*a*, in its outer area as control grid 203 and abuts against and is bonded to the upper electron-emitting face of cathode 201. Electrode 202 has no grid pattern inside a radius approximately two-thirds of the radius of the circular emitting face of the cathode. Bonded to the upper face of plate 201 is dielectric disc 204, preferably fabricated of boron nitride. Disc 204 and the central region of electrode 202, having no grid pattern, have the same area and are coaxial. Control grid 203 is DC biased by lead 206, extending longitudinally through bore 207 that extends through the cathode emitting surface. Lead 206 is bonded to central portion 208 of grid 203. Grid 203 is supported by and bonded to the upper face of disc 204.

Disc 204 has a pattern identical to that of electrode 202 and supports grid 203 over its entire area. Plate 202 and disc 204 block electron emission from the center of the upper face of cathode cylinder 201 to enable a hollow electron beam to be derived from the structure illustrated in FIGS. 6–8.

The slow-wave, multi-meander-line structure of control grid 203 has an electrical length that is a quarter wavelength at the frequency of the signal from source 12. Hence, grid 203 is resonant to the input signal applied to electrode 48 to provide resonant coupling to the signal of source 12. Grid 203 includes eight parallel resonant meander lines 211, 215 and 217–222, each extending from central electrically conducting region 208 to peripheral electrically conducting region 209. Each meander line includes radial and circumferential segments, with the radial segments of adjacent meander-line pairs being shared. Grid 203 includes non-electron-emissive electrically conducting leads or wires along which r.f. current from source 12 flows. The leads comprising grid 203 must be mechanically stable, as well as non-electron-emissive; they are preferably fabricated of a material such as pyrolytic graphite.

In the embodiment illustrated in FIG. 7, the radially extending elements of each of the meander lines have equal lengths. Each of the circumferential elements of each of the meander lines subtends an arc of 45°. Thus, for example, meander line 211 includes equi-length radially extending, aligned conducting elements 212.1–212.6, as well as radially extending, aligned elements 213.1–213.6 that are displaced from elements 212.1–212.6 by 45°. Meander line 211 also includes circumferentially extending conducting elements 214.1–214.11, each subtending an angle of 45° and connected, at opposite ends thereof, to elements 212.1–212.6 and 213.1–213.6. Elements 212.1–212.6 and are staggered so that element 212.1 extends from center circular conductor 208 to circumferential element 214.1 having the smallest radius, while radially extending element 213.1 extends from circumferential element 214.1 having the smallest radius to circumferential element 214.2 having the second smallest radius. Radial element 212.2 extends between circumferential elements 214.2 and 214.3, while radial element 213.2 extends between circumferential elements 214.3 and 214.4. The remaining radial elements 212.3–212.6 and 213.3–213.6 are similarly spaced between circumferential elements 214.4–214.11, with radial element 213.6 extending between circumferential element 214.11 and peripheral metal ring 209.

Meander line 215, adjacent meander line 211, is configured the same as meander line 211. Meander line 215 shares radially extending elements 212.1–212.6 with meander line 211, so that r.f. current flowing in both meander lines 211 and 215 flows in elements 212.1–212.6. The conducting elements of the meander lines form inductive impedances of a line that is a quarter wavelength overall; spaces between the conducting lines form capacitive impedances of the line.

At a particular instant of time, the r.f. inductive current flow paths between central conductor 208 and peripheral conductor 209 in meander lines 211 and 215 are depicted by the arrows on the radially and circumferentially extending elements. At the particular time depicted, the inductive r.f. currents in meander lines 211 and 215 flow outwardly from center region 208 along radial element 212.1. The r.f. current in meander line 211 flows clockwise in circumferentially extending element 214.1, until it encounters radially extending element 213.1; the inductive r.f. current flows outwardly in element 213.1 between arcuate elements 214.1 and 214.2. At arcuate element 214.2, the inductive r.f. current flows counterclockwise until it reaches radially extending element 212.2; the current flows radially in element 212.2 between arcuate elements 214.3 and 214.4. The inductive r.f. current in meander line 211 continues in this manner until it reaches radial element 213.6, where it flows between arcuate element 214.11 and peripheral region 209.

Simultaneously, r.f. conduction current flows in meander line 215 from central region 208 outwardly through radial element 212.1, thence to arcuately-extending element 214.1.

The current flowing in arcuate element 214.1 flows counterclockwise to radial element 217.1. The current flows through radial element 217.1 outwardly between arcuate elements 214.1 and 214.2. From arcuate element 214.2, the r.f. conduction current flows clockwise to radially extending element 212.2; the current flows radially outwardly in element 212.2 to arcuate element 214.3. The r.f. conduction current flows through the arcuate and radial elements of meander line 215 in the stated manner, with the current in arcuate element 214.11 flowing into radial element 217.6. The current flowing outwardly in radial element 217.6 flows into peripheral region 209. The r.f. conduction current flows simultaneously in each of meander lines 217–222 in the manner indicated for lines 211 and 215.

The r.f. field variation as a function of radius between grid 203 and the planar emitting face of cathode 201 in the region of the grid through which the annular electron beam passes is relatively constant compared to the r.f. field variations in the central portion of the grid which is in the electron-free space inside the annular beam, i.e., the r.f. field variation with radius is roughly constant in the outer portion of grid 203, but is substantial in the grid interior.

Figure 11:
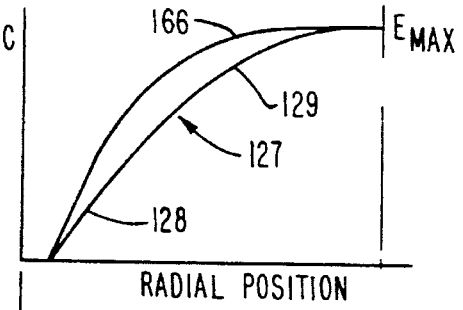
FIG. 11 is a plot of the electric-field variation between the control grids of FIGS. 7, 9 and 10 and the cathode illustrated in FIG. 6, as a function of radial spatial position.

The r.f. field variation of the grid illustrated in FIG. 7, as a function of radius along a particular meander line, is illustrated by waveform 127, FIG. 11, wherein radial position is plotted along the horizontal axis, and r.f. electric field magnitude between the grid and cathode is plotted along the vertical axis. R.f. field waveform 127 is shaped as a sinusoid including portions 128 and 129, respectively having relatively large and small slopes. Sloping portion 128 subsists between the outer periphery of central region 208 and the perimeter of plate, i.e., thin sheet electrode, 202 and disc 204, where the r.f. value is about 80% the maximum value of waveform 127. Disc 204 has a radius equal to the radius of arcuate portion 214.7. Relatively constant waveform portion 129 extends between arcuate portion 214.7 and peripheral ring 209. Because the hollow electron beam derived from cathode 201 encounters a relatively constant electric field versus radius at any particular time instant, all portions of a particular cross section of the electron beam are modulated similarly.

Greater mechanical stability for control grid 203 can be achieved by increasing the diameter of boron nitride disc 204 so that the disc and control grid have the same diameter. In such a configuration (not shown), the entire control grid 203 is positioned on the upper face of disc 204. To enable the hollow electron beam to be formed so that it propagates from cathode 201 to collector 352, disc 204 is then provided with multiple longitudinally extending bores throughout the active region of the beam, i.e., between the radius of arcuate segment 214.7, as illustrated in FIG. 7, and the periphery of control grid 203. The bores are all cut perpendicularly to boron nitride disc 204 and are generally rectangular in shape with arcuate elongated sides (though of different curvatures and lengths), to match the openings in grid 203. Thus, the thin wires of grid 203 are supported while there is minimal obstruction of electrons flowing from cathode 201 toward anode 51 and eventually collector 352. Preferably, sheet electrode 202 is likewise extended in radius to the full cathode radius and perforated with generally rectangular openings exactly matching one-for-one the openings in boron nitride plate 204 and grid 203. Electrons are thereby emitted only in the openings and there is no interception of electrons by dielectric plate 204 or grid 203. The perforated thin electrode 202 is referred to as a focus electrode because it forms separate electron emission "beamlets" that are launched through the congruent aligned layered arrangement of openings in electrodes 202, 204 and 203.

It is desirable for the electric field applied by grid 203 to the annular beam to be as constant as possible versus radius. Such a result can be achieved by designing grid 203 so that an even larger percentage of the electrical length of the grid slow-wave structure is between the center of the grid and the inner diameter of the electron beam, i.e., so that the number of electrical degrees of the grid slow-wave structure in the electron-free area inside of the beam is much greater than the number of electrical degrees of the grid meander line traversing the annular beam. For example, it would be desirable for the meander line to be designed so that the path through the meander line between the center of grid 203 and the portion of the grid which is coincident with the outer diameter of the solid portion of disc 204 has an electric length of 70 degrees of the wavelength of source 12; in such a situation, the portion of the grid meander line extending between the outer diameter of the solid portion of disc 204 and the periphery of grid 203 has an electric length of 20°. Because there is a trivial amplitude variation, about 6%, in a sine wave between 70° and 90°, the r.f. electric field has only a slight variation across the electron beamlets. These types of results can be achieved with the control grid embodiments of FIGS. 9 and 10.

Figure 9:
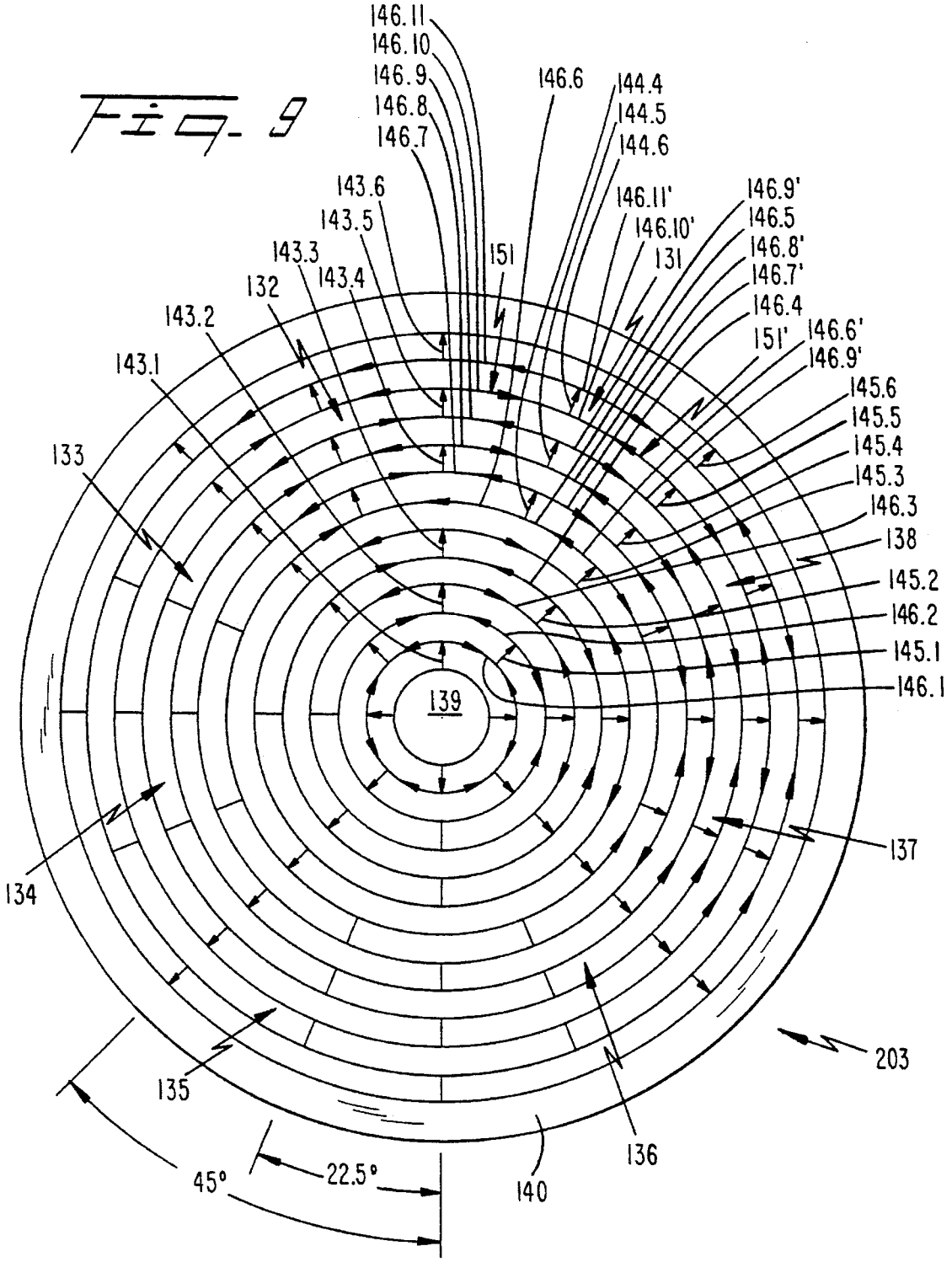
FIG. 9 is a top view of a further embodiment of a control grid of a tube similar to that illustrated in FIG. 1, wherein the control grid includes a step in the angular extent or span of a slow-wave multiple-meander-line resonant structure forming the control grid.

In the FIG. 9 embodiment, the electrical length of the meander line of grid 203 is decreased in the outer region corresponding to the annular electron beam by introducing a step change in the angular extent or span of the meander line so that the angular extent is greater inside the annulus than within the annulus. In the FIG. 10 embodiment, a similar result is achieved by step changing the radial pitch of the meander line so that adjacent elements of the meander line are spaced farther from each other in the outer region corresponding to the annular beam than inside the annulus. Similar results are attained by providing grids with gradually or stepwise changing radial pitches and/or stepwise changing angular extents or by combinations thereof.

In FIG. 9, grid 203 includes eight parallel, identical meander lines 131–138 extending between the grid center, circular portion 139 and the peripheral ring-shaped portion 140 thereof. As in the previous embodiments, the entire grid structure is made of a non-electron-emissive, electrically conducting material having the required mechanical and electrical stability. Each of meander lines 131–138 is the same, so that a description of meander line 131 suffices for the remaining meander lines.

Meander line 131 has a total electrical length of one-quarter of the wave length of the frequency of source 12, whereby the meander line is resonant to source 12. The portion of meander line 131 that extends through the hollow, center portion of electron beam 23 is identical to the corresponding portion of meander line 211, FIG. 7. At or near the inner edge of the annular electron beam, the angular extent of meander line 131 decreases by a factor of two, from 45° to 22.5°. At the grid radius aligned with this intersection, meander line 131 divides to form two parallel meander line portions.

To these ends, meander line 131 includes radially extending electrically conducting elements 143.1–143.6, 144.4–144.6 and 145.1–145.6. Each of elements 143.1–143.6, 144.4–144.6 and 145.1–145.6 has the same radial extent, with elements 143.1–143.6 being angularly aligned; elements 145.1–145.6 being angularly aligned; and elements 144.4–144.6 being angularly aligned. Elements 143.1–143.6 are angularly spaced from elements 145.1–145.6 by 45°, while elements 144.4–145.6 are angularly spaced from both of elements 143.1–143.6 and 145.1–145.6 by 22.5 degrees.

Elements 143.1–143.3 are respectively connected to elements 145.1–145.3 by arcuate, circular, coaxial electrically conducting elements 146.1–146.6, each formed as a sector of a circle having an angular extent of 45°. At or near the inner edge of the annular electron beam, meander line 131 divides into parallel meander line portions 151 and 151', each having an angular extent of 22.5°. To these ends, line portion 151 includes arcuate segments 146.7–146.11, while line portion 151' includes arcuate segments 146.7'–146.11'; all of segments 146.7–146.11 and 146.7'–146.11' are coaxial circular sectors having an angular extent of 22.5°. Arcuate segment 146.7 of line portion 151 extends between the outer tip of radial element 144.4 and the inner tip of radial element 143.4 while arcuate segment 146.6' of line portion 151' extends between the outer tip of radial element 145.3 and the inner tip of radial element 144.4. Similarly, arcuate elements 146.7–146.11, all of which are sections of a circle coincident with center 139, but at ever increasing radii from the center, respectively extend between radial elements 143.4–143.6 and 144.5 and 144.6; arcuate segments 146.7–146.11 respectively extend between radial elements 144.4–144.6 and 145.4–145.6.

The r.f. conduction current flows in segments 145.3–145.6, 144.4–144.6, 143.4–143.6, 146.6–146.11, and 146.7–146.11 via paths about to be described. The current path of meander line 131 from center region 139 to and through radial element 145.3 is substantially the same as the corresponding path in the grid of FIG. 7. The arcuate element including element 146.6 has an angular extent of 45° between the opposite ends thereof, extending 22.5° on opposite sides of the radius including elements 143.1–143.6.

The conduction current flow path of line portion 151 from radial element 144.4 proceeds in series through elements 146.7, 143.4, 146.8, 144.5, 146.9, 143.5, 146.10, 144.6, 146.11 and 143.6 to peripheral region 140 in the named order. The current flow path of line portion 151' from radial element 144.4 proceeds through elements 146.7', 145.4, 146.8', 144.5, 146.9', 145.5, 146.10', 144.6, 146.11', and 145.6 to region 140 in the named order. Current flowing in radially extending elements 143.4–143.6 and 145.3–145.6 of meander line 131 is shared with current flowing in corresponding radially extending elements of meander lines 132 and 138.

The r.f. currents flowing in meander line portions 151 and 151', between radial segment 144.4 and the peripheral portion 140, have the same amplitude because these short meander line portions are electrically in parallel with each other and have the same impedance. The same electric field variations subsist across meander line portions 151 and 151' between radial segment 144.4 and peripheral portion 140 because these line portions have the same geometry and electrical properties.

There is only a slight variation in the magnitude of the grid-to-cathode electric field over the annular electron beam region that subsists between arcuate elements 146.7 and 146.7' and peripheral region 140 because the electrical length of each of meander line portions 151 and 151' overlying the outer annular emitting portion of the cathode is a small percentage of the total quarter-wavelength electrical length of meander line 131 from central region 139 to peripheral region 140; this is true for a zero electric field between cathode 201 (FIG. 6) and grid 203 located at central region 139. The electric field variation is graphically illustrated in FIG. 11 by curve 166, having a much lower slope than curve 129 over the outer annular region of the hollow electron beam.

Figure 10:
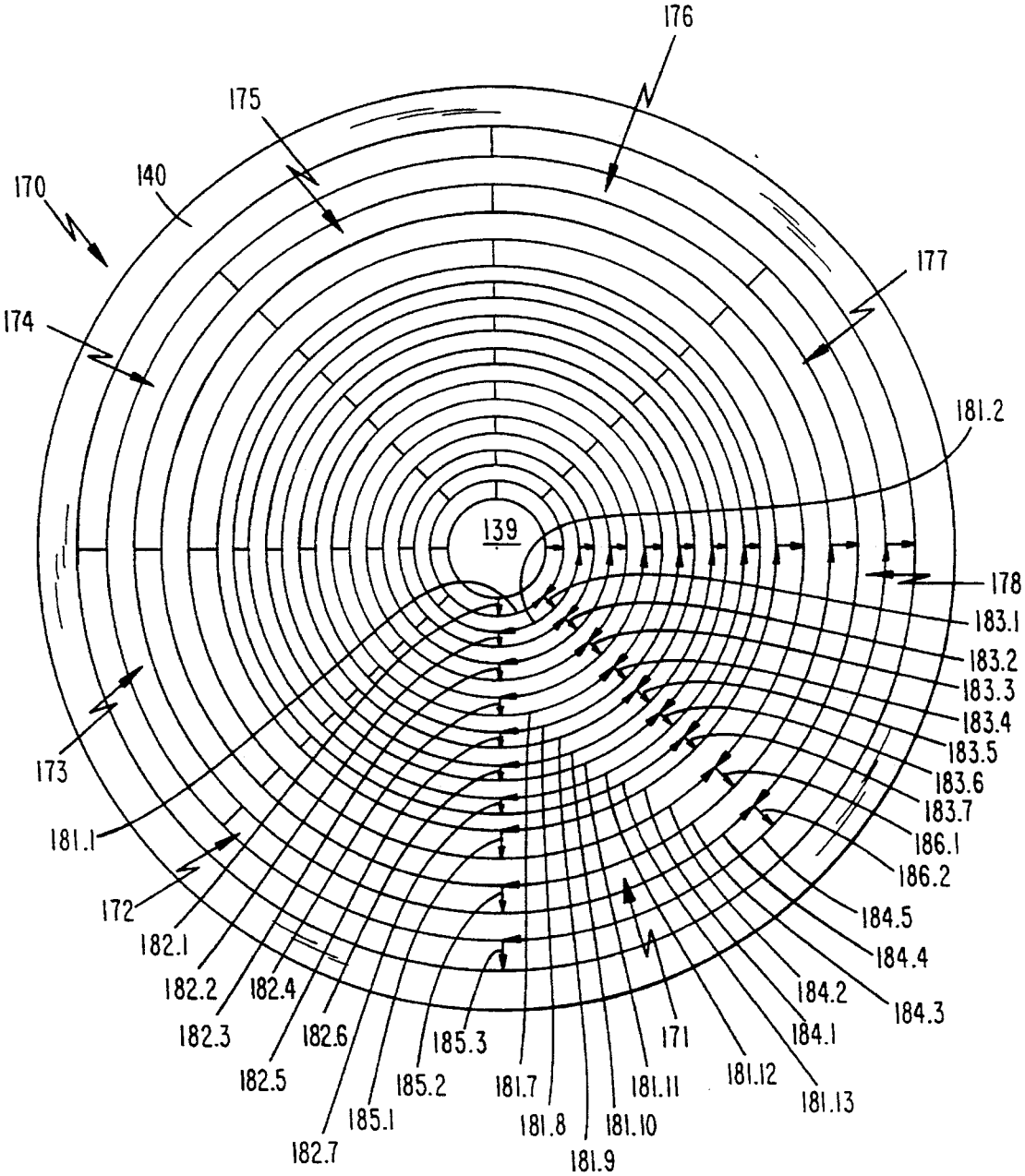
FIG. 10 is a top view of another embodiment of a control grid for a tube similar to that of FIG. 1, wherein the control grid includes plural, parallel meander lines, each having a step in the pitch of the meander line at a radial position along the meander line.

Virtually the same result as is achieved in the embodiment of FIG. 9 is achieved in the embodiment of FIG. 10, wherein eight identical meander lines 171–178, each subtending an angle of 45°, extend between center and peripheral regions 139 and 140 of control grid 170. Each of meander lines 171–178 has an electrical length of a quarter wavelength for the frequency of source 12. In one example, meander lines 171–178 are designed so that there is approximately 70° of electrical length for that part of the grid overlying the non-emissive center of the cathode and approximately 20° of electrical length over the remaining outer portion of the grid. Thereby, there is a very small variation in the electric field subsisting between grid 170 and cathode 201 over the region of the electron beam. All of the hollow electron beam is therefore modulated to approximately the same degree in response to the input signal of source 12. Because each of meander lines 171–178 has an identical construction, a description of meander line 171 suffices for the remaining meander lines.

Meander line 171 includes interior and exterior electrically conducting portions. The interior portion of meander line 171 comprises concentric arcuate segments 181.1–181.13, interior radial segments 182.1–182.7 and interior radial segments 183.1–183.7; arcuate segments 181.1–181.13 extend between radial segments 182.1–182.7 and 183.1–183.7. Each of arcuate segments 181 is a sector of a circle subtending an angle of 45° and each of radial segments 182.1–182.7 and 183.1–183.7 is of equal length. In one example, the electrical length over the interior portion of meander line 171 from central region 139 to arcuate segment 181.13 is approximately 70 degrees at the frequency of r.f. source 12.

In this example, the remaining 20 degrees of the electrical length of meander line 171 occur over the part of the grid overlying the emissive outer portion of the cathode, resulting in only a small electric field variation over the latter region. To these ends, the outer portion of meander line 171 includes concentric outer arcuate segments 184.1–184.5, as well as radially extending segments 185.1–185.3, 186.1 and 186.2. Each of radial segments 185.1–185.3 and 186.1, 186.2 has an equal length and each of arcuate segments 184.1–184.5 is a sector of a circle subtending an angle of 45° between a pair of radial segments 185.1–185.3 and 186.1, 186.2. Radial segments 181.1–181.13 and 183.1–183.7 of meander line 171 are shared with meander line 178, while segments 185.1–185.3 and 186.1, 186.2 of line 171 are shared with meander line 172.

The lengths of radial segments 185.1–185.3 and 186.1, 186.2 are considerably in excess of the lengths of radial segments 182.1–182.7 and 183.1–183.7 to provide the desired relationship between the total developed lengths of the interior and exterior portions of meander line 171. Typically, radial segments 185.1–185.3 and 186.1, 186.2 are about two to three times as long as radial segments 182.1–182.7 and 183.1–183.7. The resulting pitch change of meander line 171, in the radial direction, produces the desired variation in electric field between grid 170 and cathode 201, as depicted by waveform 166, FIG. 11.

Figure 12:
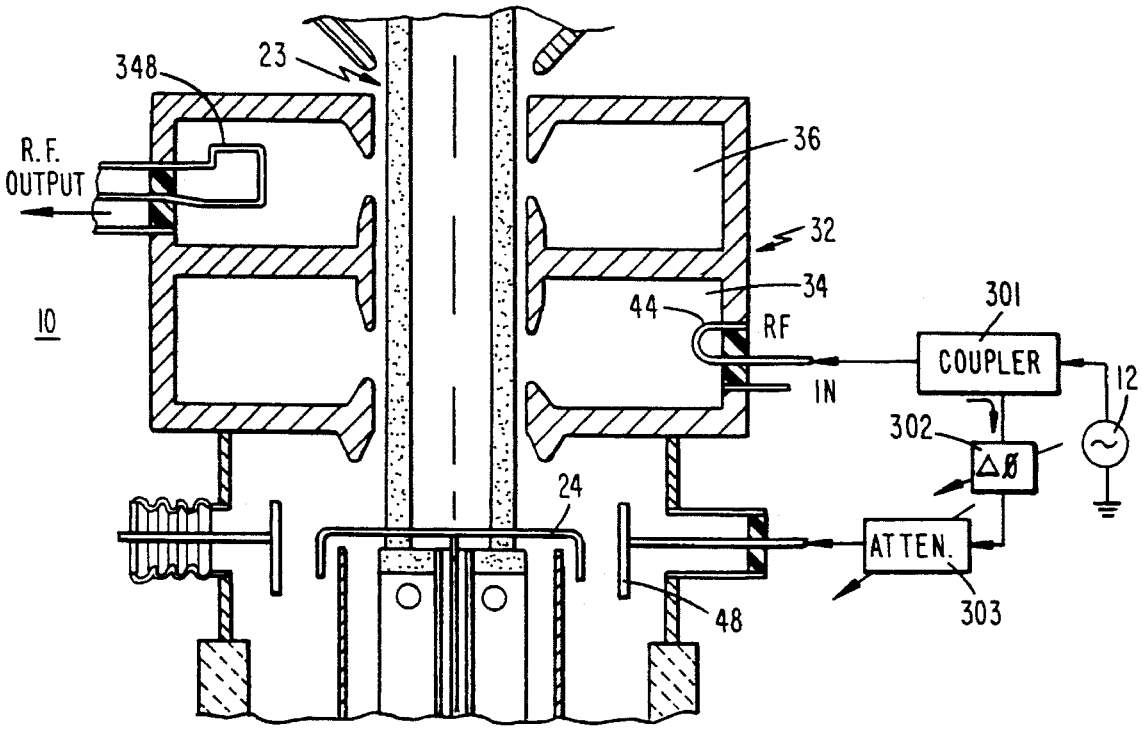
FIG. 12 is a partial longitudinal-sectional view of a further modification of the tube illustrated in FIG. 1, wherein the r.f. input signal to be amplified is coupled in parallel to a tuned cavity and to a control grid via a delay element located outside of the vacuum tube.

An alternate structure for coupling r.f. signal source 12 to coupling loop 44 and control grid 24 by way of capacitor plate 48, while achieving control outside of the vacuum tube envelope of the relative phases of the signals coupled to the loop and grid, is illustrated in FIG. 12. In the embodiment of FIG. 12, r.f. signal source 12 is connected to one port of coupler 301, having second and third ports respectively connected to loop 44 and variable delay line or phase shift circuit 302. Circuit 302 has an output connected to plate 48 by way of variable attenuator 303. The settings of delay element 302 and attenuator 303 are such that electron beam 23 is coupled to output cavity 36 so the output signal at loop 348 has maximum value. Delay element 302 and attenuator 303 are both located externally of cavity block 32 and the envelope of tube 10, so both can be easily adjusted.

Coupler 301 is either a directional coupler or circulator; both function equivalently. The r.f. signal from source 12 is supplied via coupler 301 to loop 44 and a reflected wave from the loop is supplied to delay element 302.

In FIG. 12, the tube is illustrated as including a grid-cathode arrangement of the type illustrated in FIGS. 6–10, such that hollow electron beam 23 derived from the cathode is modulated by the axial electric field subsisting between the cathode and the slow-wave structure on the control grid in response to the signal of source 12. The electron beam is further modulated by r.f. signal 12 as a result of the field coupled to the electron beam by inductively tuned cavity 34 which is driven by coupling loop 44. Delay element 302 is adjusted so that the modulations imposed on the electron beam by control grid 24 and by cavity 34 are in appropriate phase relation, resulting in maximum amplitude of the signal coupled to r.f. output loop 348 in cavity 36. It is to be understood, however, that the coupling circuit illustrated in FIG. 12 is equally applicable to the cathode-grid configuration of FIGS. 2–5 and that the same modulation mechanism occurs in both instances.

Figure 13:
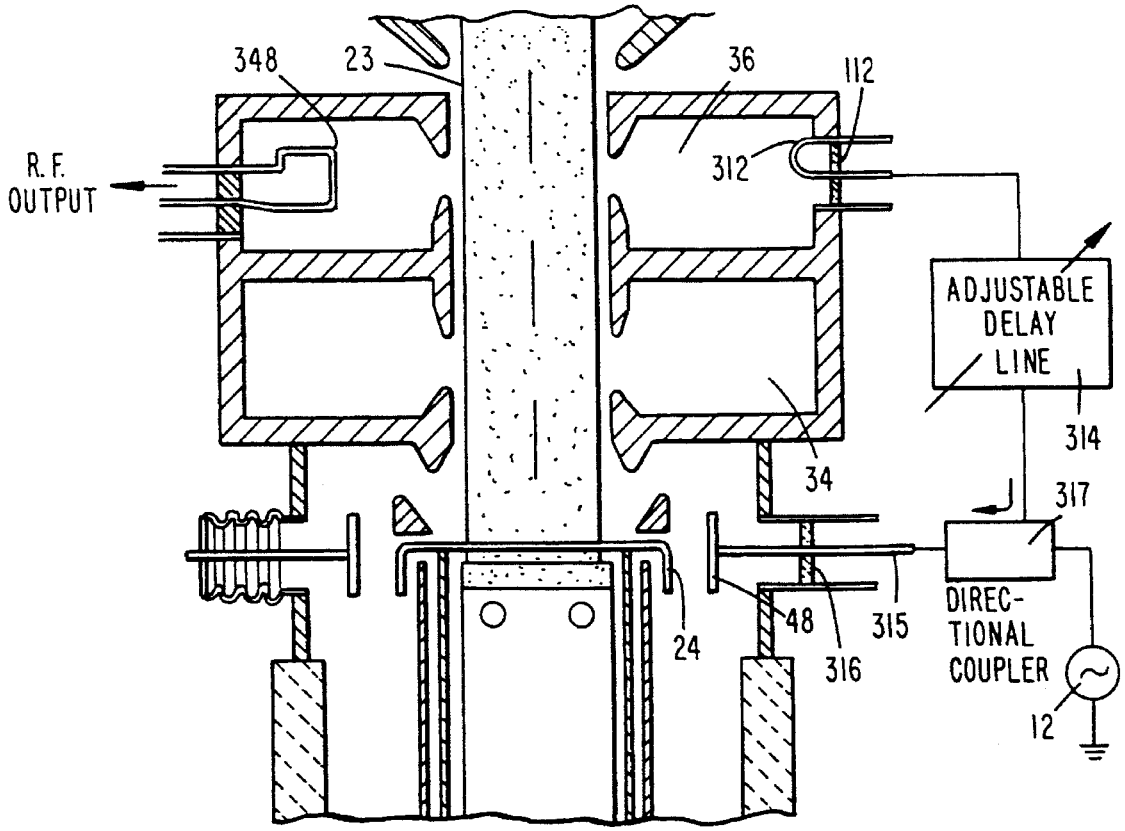
FIG. 13 is a partial longitudinal-sectional view of an additional modification of the tube of FIG. 1 wherein a signal is fed back from an output cavity to the control grid to current modulate an electron beam, with velocity modulation of the beam being produced by a cavity between the control grid and output cavity.

Reference is now made to FIG. 13 of the drawing wherein a further embodiment of the invention is illustrated as including control grid 24 that is responsive to r.f. energy from r.f. source 12 and from output cavity 36 to modulate the amplitude of current in electron beam 23 before the beam is coupled to cavity 34, interposed between grid 24 and the output cavity. To these ends, the energy in output cavity 36 is inductively coupled by loop 312 to adjustable delay line 314. The signals from source 12 and delay line 314 are supplied to separate ports of directional coupler 317, having an output connected via lead 315 to plate 48 that is coupled to grid 24. Loop 312 and lead 315 extend through walls of the tube through seals 112 and 316, respectively. Delay line 34 is adjusted and the polarity of the ports of coupler 317 are arranged so that a maximum voltage amplitude is derived from the r.f. output of loop 348 in output cavity 36.

In operation, the voltage coupled to grid 24 via lead 315 and plate 48 and the DC bias imposed on the grid cause electron beam 23 to be formed as bunches which generally subsist for approximately one-half of a cycle of r.f. source 12. The amplitude of the current in the bunches is determined by the amplitude of the signal coupled to grid 24 via coupler 317. The electron bunches passing through grid 24 in beam 23 are velocity modulated by intermediate cavity 34 which reshapes the bunches. Cavity 34 is a cavity tuned approximately to the frequency of source 12, but has a resonant frequency slightly higher than that of the source, so that the cavity is inductively tuned. Cavity 34 causes electron beam 23 to increase in power, while providing high efficiency. However, there is little voltage gain, although there is substantial power gain, in the configuration of FIG. 13.

Figure 14:
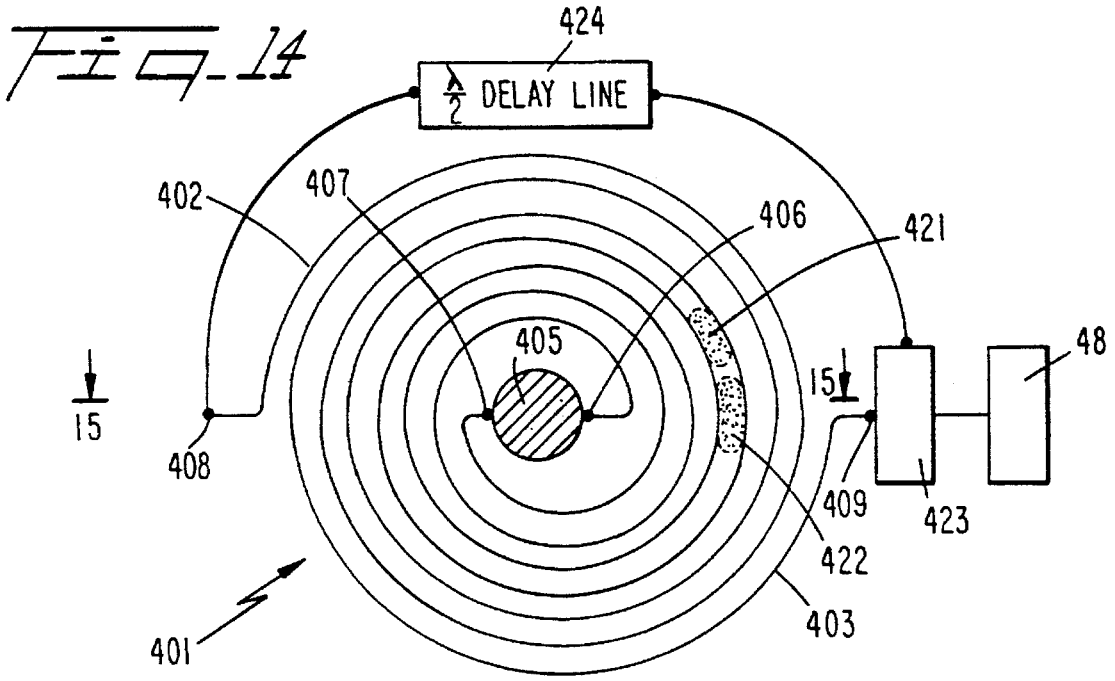
FIG. 14 is a top-view of another embodiment of a control grid that is an alternate to the grids illustrated in FIG. 9 or 10 and is used for frequency multiplication of an r.f. input signal.
Figure 15:
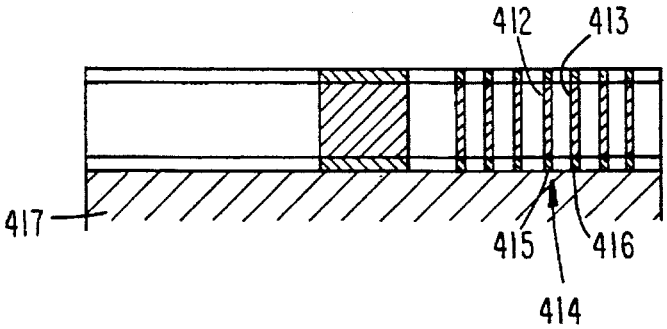
FIG. 15 is a side-sectional view taken through the lines 15—15, FIG. 14.

Reference is now made to FIGS. 14 and 15 wherein there are respectively illustrated top and side sectional views of an alternative to the meander line, resonant slow wave structure of FIGS. 6 and 7. In FIGS. 14 and 15, grid 401 is configured as a pair of interlaced metal, flat pancake-like spirals 402 and 403 having the same geometry as specifically illustrated in FIG. 14. Each of spirals 402 and 403 has a length equal to a quarter wavelength at the r.f. frequency of source 12 (FIG. 1) so it is a resonant coupling structure. Each of spirals 402 and 403 begins and ends 180° apart. Spirals 402 and 403 terminate on center circular metal plate 405, with spiral 402 having an interior end terminal 406 on the right side of plate 405, as viewed in FIG. 14, while spiral 403 has end terminal 407 on the left side of the center plate. Spirals 402 and 403 have peripheral end terminals 408 and 409 on the left and right sides of the configuration illustrated in FIG. 14.

As illustrated in FIG. 15, spirals 402 and 403 are respectively supported by and are congruent with boron nitride dielectric spacers 412 and 413. Boron nitride spacers 412 and 413 are mounted on focus grid 414, including spiral elements 415 and 416, having the same spatial configuration as spirals 402 and 403. Elements 415 and 416 of focus electrode 414 are mounted on the top, electron emitting face of cathode 417.

The emitting surface of cathode 417 and the arrangement of focus electrode 415 are such that multiple electron sheet type beamlets are formed and flow between cathode 417 and collector 352 (FIG. 1) while spirals 402 and 403 are positively biased with respect to the cathode. Two such beamlets 421 and 422 are illustrated in FIG. 14.

The r.f. energy may be coupled with the same phase to spirals 402 and 403 to cause the beamlets to be formed at the same frequency as the frequency of source 12. However, in the preferred embodiment, spirals 402 and 403 are driven with r.f. signals that are phase displaced from each other by 180°. This causes the frequency of the r.f. signal in the output cavity to be twice the frequency of source 12.

To these ends, as illustrated in FIG. 14, the r.f. signal from source 12 (FIG. 1) supplied to metal tab 48 is capacitively coupled to metal tab 423 to which terminal 409 of spiral 403 is connected. Tab 423 is also connected to terminal 408 of spiral 402 via delay line 424. The length of delay line 424 is adjusted so that the r.f. signals at terminals 408 and 409 are 180° displaced from each other. Thereby, during a first half cycle of r.f. source 12, a positive voltage is applied to spiral 402 relative to cathode 417 while a negative voltage is being applied to spiral 403. During the alternate half cycles of the source 12, the situation is reversed so that the voltage of spiral 403 is positive relative to the cathode, while the voltage applied to spiral 402 is negative with respect to the cathode.

During the first half cycle of source 212 while spiral 402 is positive relative to cathode 417, one half of the beamlets of the electron beam flowing from cathode 417 to collector 352 (FIG. 1) flow, while the remaining beamlets are suppressed. During the other half cycle of source 12, the remaining beamlets flow, to the exclusion of the beamlets which flow during the first half cycle. The frequency of the electron beam flowing from cathode 417 to collector 352 (FIG. 1) and through the output cavity is thereby increased by a factor of two, to double the frequency of the electron beam and r.f. signal in the output cavity relative to the frequency of source 12. The output cavity is resonant to twice the frequency of the r.f. signal. Hence, the spiral configuration of FIGS. 14 and 15 provides many of the same advantageous results as the cathode grid configuration of FIGS. 6 and 7, while providing frequency doubling of the r.f. source.

The configuration illustrated in FIGS. 14 and 15 can be expanded to N interlaced spirals, spatially displaced from each other by $$\frac{2\pi}{N}$$

radians, with the excitation of each spiral being displaced by $$\frac{2\pi}{N}$$

electrical radians, where N is any integer greater than one. For example, if it is desired to multiply the frequency of the r.f. signal by a factor of four, four spirals are provided, each of which is 90° displaced from each other, and the r.f. signal applied to each spiral is displaced by 90°.

While there have been described and illustrated several specific embodiments of the invention, it will be clear that variations in the details of the embodiments specifically illustrated and described may be made without departing from the true spirit and scope of the invention as defined in the appended claims.

What is claimed is:

1. Apparatus for multiplying the frequency of an AC signal by a factor N, where N is an integer greater than one, comprising an electron tube including a cathode for emitting an electron beam, a grid including N segments in proximity to the cathode and positioned to be responsive to the beam emitted by the cathode, the grid being electrically biased and electrically coupled to the signal for causing the beam to be configured as N groups of electron bunches during each cycle of the signal so that each of the segments accelerates one group of said N groups of electron bunches for a duration of about 1/N th of each cycle of the signal, different groups of said N groups of electron bunches associated with the different segments being accelerated at phases displaced from each other during each cycle of the signal, and means responsive to the N groups of bunches for deriving an output signal having a frequency N times that of the signal.

2. The apparatus of claim 1 wherein each of the segments is configured to that each of said segments is resonant to the frequency of the signal.

3. The apparatus of claim 1 wherein each of the segments is configured as a slow-wave structure resonant to the frequency of the signal.

4. The apparatus of claim 3 further including means for inductively coupling the signal to the segments with different phases.

5. The apparatus of claim 1 wherein the grid and cathode electrodes are spaced from each other by no more than the distance an emitted electron from the cathode can travel in a quarter cycle of the signal.

6. The apparatus of claim 5 wherein each of the segments has a length, the length of each of said segments being effective to provide a slow-wave structure resonant to the frequency of said signal.

7. The apparatus of claim 6 further including means for inductively coupling the signal to said slow-wave resonant structure.

8. The apparatus of claim 1 wherein each of the segments is configured as a slow-wave structure.

9. The apparatus of claim 1 wherein the signal is coupled to the grid such that said signal is applied to each of the segments, and further including means for phase shifting the signal applied to each of the segments so that the signal applied to a particular segment k is phase shifted by $$\frac{2\pi(k-1)}{N}$$

relative to the signal applied to a first of said segments in closest proximity to the cathode, where k is any integer from 1 to N.

10. The apparatus of claim 9 wherein the electron beam flows in a direction from the cathode toward the grid, the beam having different radial positions with respect to a center portion thereof, the grid being is configured as a pancake-shaped structure having a planar surface at substantially right angles to the direction of electron beam flow, each of the segments having an angular extent of at least 360°, each of the segments having a different angular portion intersecting a different radial portion of the beam.

11. The apparatus of claim 10 wherein each of the segments is configured as a separate spiral, each of the spirals being interlaced.

12. The apparatus of claim 11 wherein the grid and cathode electrodes are spaced from each other by no more than the distance an emitted electron from the cathode can travel in a quarter cycle of the signal.

13. The apparatus of claim 12 wherein each of the segments has a length, the length of each of said segments being effective to provide a slow-wave structure resonant to the frequency of said signal.

14. The apparatus of claim 13 further including means for inductively coupling the signal to said slow-wave resonant structure.

* * * * *